US005482281A

United States Patent [19]

Anderson

[11] Patent Number: 5,482,281

[45] Date of Patent: Jan. 9, 1996

[54] GOLF PUTTER HEAD

[75] Inventor: Douglas W. Anderson, Glendale, Ariz.

[73] Assignee: Karsten Mfg. Corp., Phoenix, Ariz.

[21] Appl. No.: 390,053

[22] Filed: Feb. 17, 1995

[51] Int. Cl.[6] ..... A63B 53/04

[52] U.S. Cl. ..... 273/169; 273/167 A; 273/167 K; 273/173

[58] Field of Search ..... 273/167 R, 167 A, 273/167 F, 167 G, 167 K, 169, 173, 174

[56] References Cited

U.S. PATENT DOCUMENTS

| | | | |
|---|---|---|---|
| 1,897,264 | 2/1933 | Lamb | 273/174 X |
| 1,901,562 | 3/1933 | Main | 273/169 |
| 2,014,829 | 9/1935 | Young | 273/174 |
| 2,486,952 | 11/1949 | Kearsley et al. | 273/169 X |
| 3,042,405 | 7/1962 | Solheim | 273/167 G X |
| 3,954,265 | 5/1976 | Taylor | 273/80 |
| 4,222,566 | 9/1980 | Berry | 273/164 |
| 4,695,054 | 9/1987 | Tunstall | 273/173 X |
| 4,714,252 | 12/1987 | Roraback | 273/171 |
| 4,722,528 | 2/1988 | Tsao | 273/164 |
| 4,834,387 | 5/1989 | Waites et al. | 273/164 |
| 5,211,401 | 5/1993 | Hainey | 273/167 |
| 5,320,346 | 6/1994 | Phillips | 273/79 |
| 5,320,353 | 8/1994 | Moore | 273/167 |
| 5,324,031 | 8/1994 | Green | 273/78 |

*Primary Examiner*—William H. Grieb
*Attorney, Agent, or Firm*—D. Marquette; H. Haynes

[57] ABSTRACT

A golf putter head including a lower plate-like member made of heavyweight material such as bronze or steel and an upper shell-like member made of lightweight material such as wood, aluminum or plastic. A heel weight and a toe weight are mounted on the lower plate-like member adjacent its heel and toe ends, respectively. The heel and toe weights extend upwardly and are preferably made of the same heavyweight material as the lower plate-like member. A socket is formed in the heel weight for receiving a lower end of a golf putter shaft, and a hole is formed in the upper shell-like member in alignment with the socket to permit the shaft to pass through the upper shell-like member. The putter head has a low center of gravity and a high resistance to torque.

19 Claims, 1 Drawing Sheet

GOLF PUTTER HEAD

BACKGROUND OF THE INVENTION

This invention relates generally to golf clubs and, in particular, to a golf putter head.

U.S. Pat. No. 4,722,528 to Tsao discloses a golf putter with a head consisting of a sole plate formed of heavyweight material such as steel and a body member made of lightweight material such as aluminum. A pair of knurled pins secure the sole plate to the body member. The sole plate has increased mass concentrations at its heel and toe ends. The putter has a shaft secured to the body member by a connecting member.

U.S. Pat. No. 4,834,387 to Waites et al discloses a golf putter having a head comprised of a lightweight upper portion and a heavyweight base plate portion fastened together by screws. The upper portion is made of metal alloy or plastic, and the base plate portion is formed of brass or bronze. An additional brass weight is mounted in the upper portion near its toe end, and a shaft is attached to the upper portion adjacent its heel end.

U.S. Pat. No. 5,211,401 to Hainey discloses a putter head having a thick heavyweight top plate and a thin lightweight sole plate. The top and sole plates are connected by brazing, and a shaft is fixed to the top plate.

U.S. Pat. No. 5,320,353 to Moore discloses a golf putter with a head having a T-shaped brass weight disposed in a T-shaped recess in an aluminum body. The brass weight is fastened to the body by a plurality of screws, and a shaft is connected to the brass weight.

U.S. Pat. No. 4,714,252 to Roraback discloses a golf putter head having an aluminum sole with a pair of cavities that receive a pair of steel spherical weights. A cover made of wood or plastic is mounted on the sole in order to fit over the weights, and a shaft extends through a hole in the cover into another hole in the sole.

SUMMARY OF THE INVENTION

The present invention provides a golf putter head comprising a lower plate-like member having a front side, a back side, a width dimension measured between the front and back sides, a heel end, a toe end, and a length dimension measured between the heel and toe ends. A heel weight is mounted on the lower plate-like member adjacent its heel end, and a toe weight is mounted on the lower plate-like member adjacent its toe end. The heel and toe weights extend upwardly and are spaced apart in a heel-to-toe direction extending along the length dimension of the lower plate-like member. An upper shell-like member is attached to the lower plate-like member for enclosing the heel and toe weights.

In the preferred embodiment of the putter head, the lower plate-like member, the heel weight and the toe weight are made of heavyweight material such as bronze or steel, and the upper shell-like member is made of lightweight material such as wood, aluminum or plastic. The heel weight includes a socket for receiving a lower end of a golf putter shaft, and the upper shell-like member includes a hole therethrough aligned with the socket in the heel weight for permitting the golf putter shaft to pass through the upper shell-like member.

The upper shell-like member has a top wall, a front wall disposed forwardly with respect to the heel and toe weights defining an impact face, a back wall disposed rearwardly with respect to the heel and toe weights, and a pair of end walls extending alongside the heel and toe weights between the front and back walls. The top, front, back and end walls completely enclose the heel and toe weights inside the upper shell-like member. A pair of interior walls extend between the front and back walls and are arranged to cooperate with the end walls to define a pair of pockets for receiving the heel and toe weights.

DESCRIPTION OF THE PREFERRED EMBODIMENT

Figure 1:
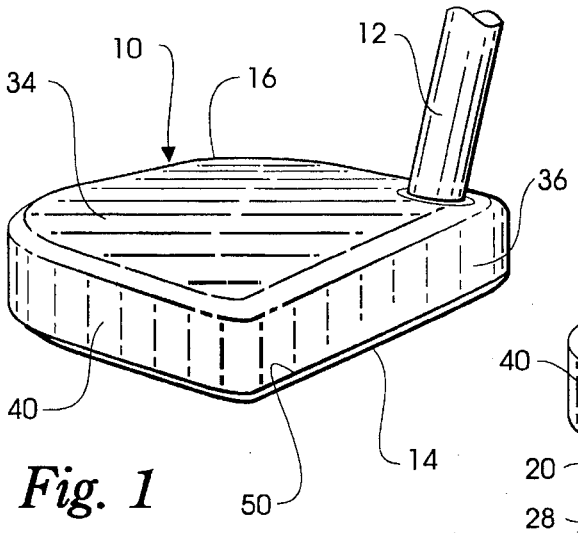
FIG. 1 is a perspective view of a golf putter head according to the preferred embodiment of the present invention.

Referring to FIG. 1, a golf putter head 10 according to the present invention is attached to a lower end of a shaft 12. A grip (not shown) is mounted on an upper end of the shaft 12. The putter head 10 is of a mallet type with heel-toe weighting. Preferably, the putter head 10 is face balanced by bending the shaft 12 so that it resembles a shaft commonly known as the "BIG Z" shaft used in golf putters manufactured by Karsten Manufacturing Corporation, the assignee of the present application.

Figure 2:
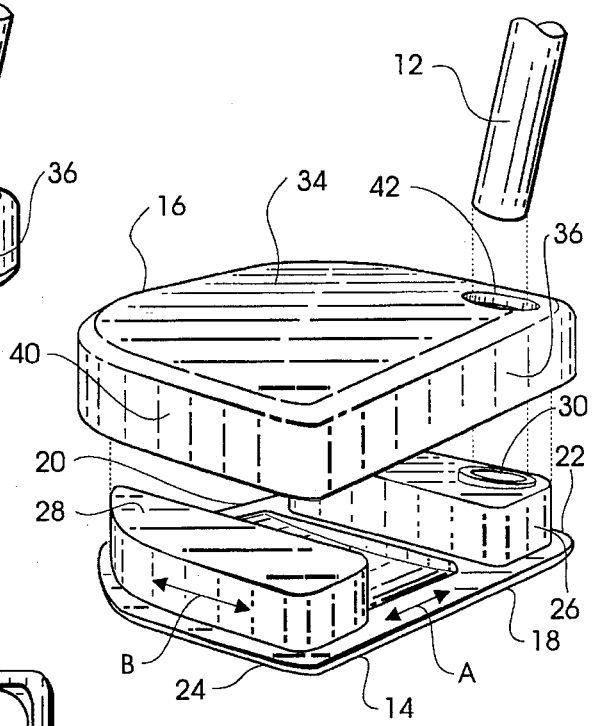
FIG. 2 is an exploded perspective view of the golf putter head shown in FIG. 1 including a lower plate-like member and an upper shell-like member.
Figure 3:
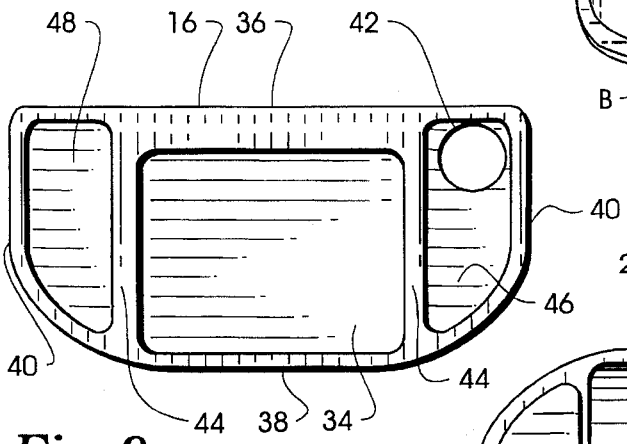
FIG. 3 is a bottom view of the upper shell-like member.

The putter head 10 includes a lower plate-like member 14 and an upper shell-like member 16. The lower plate-like member 14 has a front side 18, a back side 20, a heel end 22 and a toe end 24. A heel weight 26 is mounted on the lower plate-like member 14 adjacent the heel end 22 thereof, and a toe weight 28 is mounted on the lower plate-like member 14 adjacent the toe end 24 thereof. The heel and toe weights 26, 28 are spaced apart in a heel-to-toe direction A seen in FIG. 2 along a length dimension of the lower plate-like member 14 measured between the heel and toe ends 22, 24. The lower plate-like member 14 also has a width dimension measured between the front and back sides 18, 20. The length dimension of the lower plate-like member 14 is greater than its width dimension.

Figure 7:
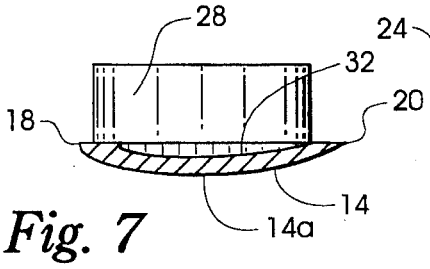
FIG. 7 is a cross sectional view of the lower plate-like member taken along lines 7—7 in FIG. 4.
Figure 5:
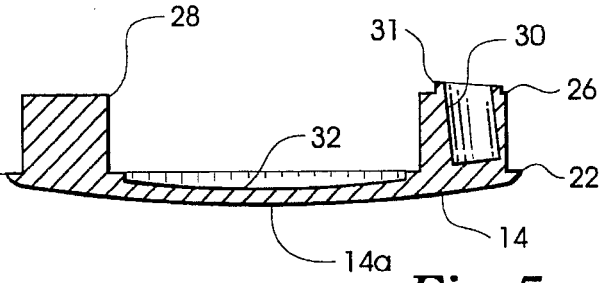
FIG. 5 is a cross sectional view of the lower plate-like member taken along lines 5—5 in FIG. 4.

The heel and toe weights 26, 28 extend upwardly and are elongated in a front-to-back direction B extending between the front and back sides 18, 20 of the lower plate-like member 14. The heel weight 26 has a socket 30 for receiving the lower end of the shaft 12. The lower plate-like member 14 has a midsection disposed between the heel and toe weights 26, 28, and a recess 32 is formed in an inner surface of this midsection. As seen in FIGS. 5 and 7, an outer surface 14a of the lower plate-like member 14 has a compound curvature formed by the outer surface bulging outwardly between the front and back sides 18, 20 while also bulging outwardly between the heel and toe ends 22, 24.

In the preferred embodiment of the putter head 10, the lower plate-like member 14, the heel weight 26 and the toe weight 28 are formed as a unitary casting. This casting is preferably made of heavyweight material such as bronze or steel. Alternatively, the lower plate-like member 14, the heel weight 26 and the toe weight 28 may be formed separately and then fastened together by conventional means such as welding.

The upper shell-like member 16 includes a top wall 34, a front wall 36 disposed forwardly with respect to the heel and toe weights 26, 28 defining an impact face, and a back wall 38 disposed rearwardly with respect to the heel and toe weights 26, 28. A pair of end walls 40 extend alongside the heel and toe weights 26, 28 between the front and back walls 36, 38. The top, front, back and end walls 34, 36, 38 and 40 completely enclose the heel and toe weights 26, 28 inside the upper shell-like member 16. A hole 42 formed in the top wall 34 is aligned with the socket 30 to permit the shaft 12 to pass through the upper shell-like member 16 without contacting the upper shell-like member 16. A pair of interior walls 44 extend between the front and back walls 36, 38 and are arranged to cooperate with the end walls 40 to define a pair of pockets 46, 48 which receive the heel and toe weights 26, 28.

It will be understood that the upper shell-like member 16 is preferably made of lightweight material such as wood, aluminum or plastic and is secured to the lower plate-like member 14 by utilizing a suitable adhesive such as epoxy. No additional fasteners (e.g. screws) are needed to secure the upper and lower members 14, 16 together. As seen in FIG. 1, the lower plate-like member 14 and the upper shell-like member 16 meet at a parting line 50 which extends around a peripheral edge 52 of the lower plate-like member 14. The parting line 50 is disposed in a plane that lies substantially parallel to the top wall 34 of the upper shell-like member 16.

Figure 4:
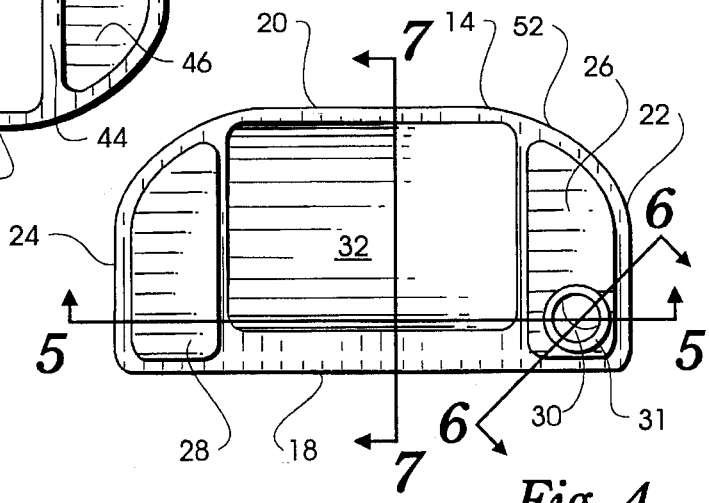
FIG. 4 is top plan view of the lower plate-like member.
Figure 6:
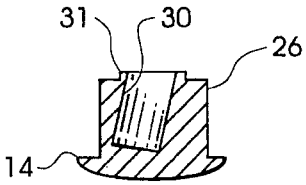
FIG. 6 is a cross sectional view of the lower plate-like member taken along lines 6—6 in FIG. 4.

An important feature of the putter head 10 is that the socket 30 in the heel weight 26 includes an upstanding boss 31 that mates with the hole 42 in the top wall 34 of the upper shell-like member 16. Another important feature of the putter head 10 is that the socket 30 in the heel weight 26 is disposed at an acute angle relative to a vertical axis through the heel weight 26 as seen in FIGS. 4–6.

It will be understood that the putter head 10 has unique weight distribution characteristics. Preferably, the lower plate-like member 14, the heel weight 26, and the toe weight 28 each weigh at least twice as much as the upper shell-like member 16. Such weight distribution provides the putter head 10 with a desirable combination of a low center of gravity and a high resistance to torque. In one version, the putter head 10 weighs about 320 grams, with the lower plate-like member 14 weighing about 110 grams, the heel and toe weights 26, 28 each weighing about 85 grams, and the upper shell-like member 16 weighing about 40 grams.

What is claimed is:

1. A golf putter head comprising:

a lower plate-like member having a front side, a back side, a width dimension measured between said front and back sides, a heel end, a toe end, and a length dimension measured between said heel and toe ends;

a heel weight mounted on said lower plate-like member adjacent said heel end;

a toe weight mounted on said lower plate-like member adjacent said toe end;

said heel and toe weights extending upwardly and being spaced apart in a heel-to-toe direction extending along the length dimension of said lower plate-like member; and an upper shell-like member attached to said lower plate-like member for enclosing said heel and toe weights.

2. The golf putter head of claim 1, wherein said lower plate-like member, said heel weight and said toe weight are made of heavyweight material and wherein said upper shell-like member is made of lightweight material.

3. The golf putter head of claim 2, wherein said heavyweight material is bronze or steel and said lightweight material is wood.

4. The golf putter head of claim 2, wherein said heavyweight material is bronze or steel and said lightweight material is aluminum.

5. The golf putter head of claim 2, wherein said heavyweight material is bronze or steel and said lightweight material is plastic.

6. The golf putter head of claim 2, wherein said lower plate-like member weighs at least twice as much as said upper shell-like member.

7. The golf putter head of claim 6, wherein said heel and toe weights each weigh at least twice as much as said upper shell-like member.

8. The golf putter head of claim 7, wherein said lower plate-like member weighs about 110 grams, said heel and toe weights each weigh about 85 grams, and said upper shell-like member weighs about 40 grams.

9. The golf putter head of claim 1, wherein said heel weight includes a socket for receiving a lower end of a golf putter shaft.

10. The golf putter head of claim 9, wherein said upper shell-like member includes a hole therethrough aligned with said socket in said heel weight for permitting said golf putter shaft to pass through said upper shell-like member without contacting said upper shell-like member.

11. The golf putter head of claim 10, wherein said socket is disposed at an acute angle relative to a vertical axis through said heel weight and includes an upstanding boss that mates with said hole in said upper shell-like member.

12. The golf putter head of claim 1, wherein said upper shell-like member comprises a top wall, a front wall disposed forwardly with respect to said heel and toe weights defining an impact face, a back wall disposed rearwardly with respect to said heel and toe weights, a pair of end walls extending alongside said heel and toe weights between said front and back walls, and wherein said top, front, back and end walls completely enclose said heel and toe weights inside said upper shell-like member.

13. The golf putter head of claim 12, wherein said upper shell-like member further comprises a pair of interior walls extending between said front and back walls and arranged to cooperate with said end walls to define a pair of pockets for receiving said heel and toe weights.

14. The golf putter head of claim 12, wherein said upper shell-like member and said lower plate-like member meet at a parting line which extends around a peripheral edge of said lower plate-like member.

15. The golf putter head of claim 14, wherein said parting line is disposed in a plane that lies substantially parallel to said top wall of said upper shell-like member.

16. The golf putter head of claim 1, wherein said lower plate-like member has a midsection disposed between said heel and toe weights, said midsection having a recess formed in an inner surface thereof.

17. The golf putter head of claim 1, wherein said lower plate-like member has an outer surface with a compound curvature whereby said outer surface bulges outwardly between said heel and toe ends while also bulging outwardly between said front and back sides.

18. The golf putter head of claim 1, wherein said heel and toe weights are elongated in a front-to-back direction extending between said front and back sides of said lower plate-like member, and wherein said length dimension is greater than said width dimension.

19. A golf putter head comprising:

a lower plate-like member made of heavyweight material having a front side, a back side, a width dimension measured between said front and back sides, a heel end, a toe end, and a length dimension measured between said heel and toe ends, said length dimension being greater than said width dimension;

a heel weight made of heavyweight material mounted on said lower plate-like member adjacent said heel end, said heel weight including a socket for receiving a lower end of a golf putter shaft;

a toe weight made of heavyweight material mounted on said lower plate-like member adjacent said toe end;

said heel and toe weights extending upwardly and being spaced apart in a heel-to-toe direction extending along the length dimension of said lower plate-like member, said heel and toe weights being elongated in a front-to-back direction extending along the width dimension of said lower plate-like member; and an upper shell-like member made of lightweight material attached to said lower plate-like member for enclosing said heel and toe weights, said upper shell-like member including a hole therethrough aligned with said socket in said heel weight for permitting said golf putter shaft to pass through said upper shell-like member.

* * * * *